US006975181B2

(12) United States Patent
Jang

(10) Patent No.: US 6,975,181 B2
(45) Date of Patent: Dec. 13, 2005

(54) DIELECTRIC RESONATOR LOADED METAL CAVITY FILTER

(76) Inventor: Sei-Joo Jang, c/o S.M. Choi Dongbu Haeoreum, Apt. 101-1109 716 Yoksam-Dong, Kangnam-Ku, Seoul (KR)

( * ) Notice: Subject to any disclaimer, the term of this patent is extended or adjusted under 35 U.S.C. 154(b) by 294 days.

(21) Appl. No.: 09/871,068

(22) Filed: May 31, 2001

(65) Prior Publication Data

US 2002/0180559 A1 Dec. 5, 2002

(51) Int. Cl.[7] ..... H01P 1/213
(52) U.S. Cl. ..... 333/134; 333/202; 333/219.1
(58) Field of Search ..... 333/134, 202, 333/219.1, 212, 203, 206, 222

(56) References Cited

U.S. PATENT DOCUMENTS 4,821,006 A * 4/1989 Ishikawa et al. ..... 333/202
4,937,533 A * 6/1990 Livingston ..... 333/126
5,714,919 A * 2/1998 Satoh et al. ..... 333/202
5,831,496 A * 11/1998 Sonoda et al. ..... 333/202
5,841,330 A 11/1998 Wenzel et al. ..... 333/202
6,025,764 A * 2/2000 Pelz et al. ..... 333/202
6,262,639 B1 * 7/2001 Shu et al. ..... 333/202
6,476,693 B1 * 11/2002 Snyder et al. ..... 333/219.1

* cited by examiner

*Primary Examiner*—Stephen E. Jones
(74) *Attorney, Agent, or Firm*—John J. Elnitski, Jr.

(57) ABSTRACT

A new type of dielectric resonator loaded metal cavity filters that are compact and resonate only the desired frequency, along with a method of making such filters. The more compact dielectric resonator loaded metal cavity filter is made by a method of stacking resonator loaded cavities into a filter. A method of making a dielectric resonator filter or duplexer filter which inhibits the undesired higher order harmonics from passing through the filter. Whereby, the method for inhibiting higher order harmonics includes differentiating sizes of the dielectric resonator and metal cavity as compare to other cavities in the filter to prevent the passage of undesired higher order harmonics through the filter.

3 Claims, 20 Drawing Sheets

DIELECTRIC RESONATOR : D>L

[+] :POSITIVE IRIS OR ELECTRIC FIELD PROBE COUPLING
⊕ :NEGATIVE ELECTRIC FIELD PROBE COUPLING

FREQUENCY RESPONCE OF D.R.I. LOADED CI.
D.R.I.=DIELECTRIC RESONATOR OF D=2.8cm, L=1.4cm
AND CI=METAL CAVITY OF 2R=7.5cm, S=3.75cm

FREQUENCY RESPONSE OF DR,2 LOADED CI.
DR2 = DIELECTRIC RESONATOR OF D=3cm AND L=1.17cm
AND CI=METAL CAVITY OF 2R=75cm AND S=3.75cm

FREQUENCY RESPONSE OF DR I LOADED C2
DR I = DIELECTRIC RESONATOR OF D=2.8cm AND L=1.4cm
AND C2= METAL CAVITY OF 2R=8cm AND S=4cm

FREQUENCY RESPONSE OF DR2 LOADED C2
DR2= DIELECTRIC RESONATOR OF D=3cm AND L=1.17cm
AND C2=METAL CAVITY OF 2R=8cm AND S=4cm

DIELECTRIC RESONATOR LOADED METAL CAVITY FILTER

BACKGROUND

It is known to couple two or more metal cavities loaded with dielectric resonators side-by-side to make a filter for a wireless microwave communication system. It is known to use two or more dielectric resonator loaded metal cavities coupled side-by-side to create a filter for a base station and repeater of a microwave communication system. It is also known to use elliptic function filter theory to design the above mentioned metal cavity filters for wireless communication systems that require a high rate of cutoff frequency response at both ends of the filter's transition band. The dielectric resonator loaded metal cavity filter only allows the resonate frequency of the resonators and its harmonics to pass through the filter and on to the output. The number of resonators used determines the characteristics of the passing signal, such as bandwidth, insertion loss, skirt response and spurious frequency response. The disadvantage to such filters is that the resonators not only allow the first harmonic of design frequency to pass, but also allow the other associated higher order harmonics of that frequency to pass through the filter. These higher order harmonics are known to interfere with other electronic devices.

FIG. 1 shows a typical cylindrical dielectric resonator used in a dielectric resonator loaded metal cavity filter. The materials for the resonator of FIG. 1 are usually dielectrics which are of a high quality factor and have a dielectric constant (K) somewhere between K=10 to 100. FIG. 2 is a top view depiction of the resonator showing its electric field lines at the lowest resonant mode. FIG. 3 is a side view depiction of the resonator showing its magnetic field lines at the lowest resonant mode. FIG. 4 shows a cylindrical metal cavity in a metal block. FIG. 5 shows the metal cavity of FIG. 4 loaded with a resonator and including a tuning screw. The resonator is shown includes a resonator support. FIG. 6 shows a detailed electric field distribution of a dielectric resonator loaded metal cavity. FIG. 7 shows a detailed magnetic field distribution of a dielectric resonator loaded metal cavity. The magnetic field of a resonator is perpendicular to the electric field of the resonator. The electric field is quite strong everywhere within equatorial plane of the resonator, except near the resonator center. Therefore, a cylindrical plug can be removed from the center of the dielectric resonator to receive the resonator support, without disturbing the electric field and the resonant frequency, significantly.

The stored electro-magnetic energy at a resonant frequency of one cavity can be transfer to another cavity through an aperture know as an IRIS in the cavity or by a conducting coupling probe, as shown in FIGS. 8–10 and 11–14. The output and input to a filter is usually radio frequency signals to and from an antenna or signal generator. The number of dielectric resonator loaded cavities used and coupling method between those cavities determine the characteristics of a filter. Such characteristics include bandwidth, insertion loss, skirt and spurious frequency responses of a filter. The disadvantage of dielectric resonator loaded metal cavity filters is that the resonating cavities not only allow the first harmonic of desired frequency to pass, but also allow other associated higher order harmonics of that frequency to pass through the filter. These higher order harmonics interfere with other electronic devices.

FIGS. 23–24 show an example of a six-pole dielectric resonator loaded metal cavity elliptic function filter, whereby all of the cavities are coupled side-by-side. FIG. 23 shows the filter with a cover removed and depicting how the cavities are coupled. All couplings between each cavity are positive side couplings including between a cavity and the input and output of the filter, except for the negative elliptic coupling of –k(2,5) and –k(1,6) that are shown. FIG. 24 is a top view of the filter which depicts a cover with tuning screws, where there is a tuning screw for each cavity. The positive side couplings between cavities are carried out by using a positive side coupling aperture, as shown in FIG. 8. The coupling between an input or output and a cavity, and between cavities where Negative Elliptic Coupling is employed are both accomplished by using a conducting coupling probe, as shown in FIGS. 11–12. The input/output connectors are usually N or SMA-type. The resonator support can be made from polymer or ceramic or polymer/glass fiber and/or polymer/ceramic composite materials, respectively. FIGS. 25–26 shows an example of a duplexer filter made up of two side-by-side filters, whereby each of the two filters is similar to the filter shown in FIGS. 23–24. FIG. 25 shows a perspective view with a cover removed and depicting how the cavities are coupled. FIG. 26 is a top view of the filter which depicts a cover with tuning screws.

It is an object of the present invention to provide a dielectric resonator loaded metal cavity filter that is more compact in nature.

It is another object of the present invention to provide dielectric resonator loaded metal cavity filter which filters out the higher harmonics associated with the desired frequency which is to pass through the filter.

SUMMARY OF THE INVENTION

A filter of resonator loaded cavities that includes a first electrical connector and a second electrical connector. At least three resonator loaded cavities coupled between the first and second electrical connectors to allow exchange of a desired frequency between the first and second electrical connectors. Each of the cavities is loaded with a resonator. There is a first set of at least two of the at least three cavities coupled side-by-side to allow exchange of the desired frequency with the first electrical connector. There is a second set of at least one of the at least three cavities coupled to at least one of the at least two cavities of the first set in order to allow exchange of the desired frequency with the second electrical connector. There is at least one cavity of the second set positioned such that the at least one cavity of the second set is stacked in relation to the at least two cavities coupled side-by-side of the first set, as opposed to being positioned side-by-side the at least two cavities coupled side-by-side of the first set.

A filter for electronics to allow filtering out of higher harmonics of a desired frequency to be passed through the filter. The filter includes at least two coupled cavities, each of the cavities loaded with a dielectric resonator which resonates the desired frequency. The cavities and resonators have physical parameters. The resonators being a cylinder having a round top and bottom, the top and bottom connected by a continuous side, the physical parameters of the resonators being a diameter for the top and bottom and a length of the side. The cavities each being an open area of a cylinder shape in a material, the cylinder shape having a round top and bottom, the top and bottom connected by a continuous side, the physical parameters of the cavities being a diameter for the top and bottom and a length of the side. Where at least one of the at least two coupled cavities having at least one physical parameter of the physical parameters of the cavities and resonators being a different value from a same parameter in other of the at least two coupled cavities.

DETAILED DESCRIPTION OF THE INVENTION

The present invention is a new type of dielectric resonator loaded metal cavity filter and a method of making such a filter. The present invention provides methods of improving the spurious frequency characteristics of dielectric resonator loaded metal cavity filters. The present invention provides a more compact dielectric resonator loaded metal cavity filter and a method of making such a filter by stacking resonator loaded cavities. In most of the examples presented, elliptic function filter theory is employed as part of the filter. These examples are not meant to limit the scope of the invention to only filters employing elliptic function filter theory, but show one of the more complicated types of dielectric resonator loaded metal cavity filters that can be produced using the methods of the present invention.

Figure 8:
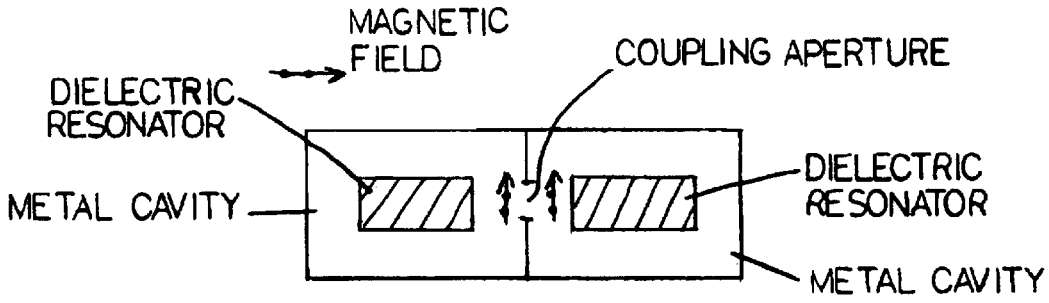
FIG. 8 is a schematic cross-sectional view of a positive side coupling of two dielectric resonator loaded metal cavities by an aperture.
Figure 9:
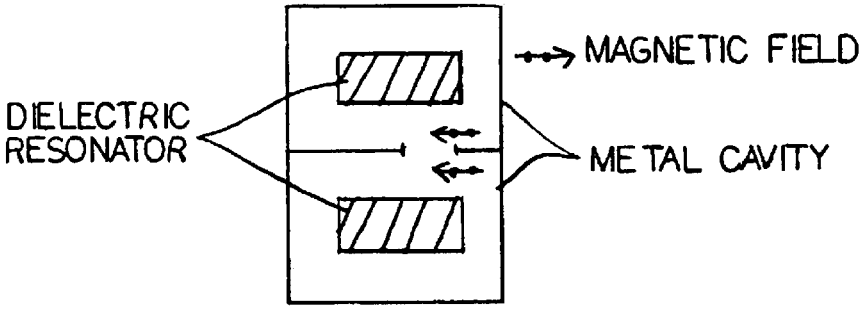
FIG. 9 is a schematic cross-sectional view of a positive radial coupling of two dielectric resonator loaded metal cavities by an aperture.
Figure 10:
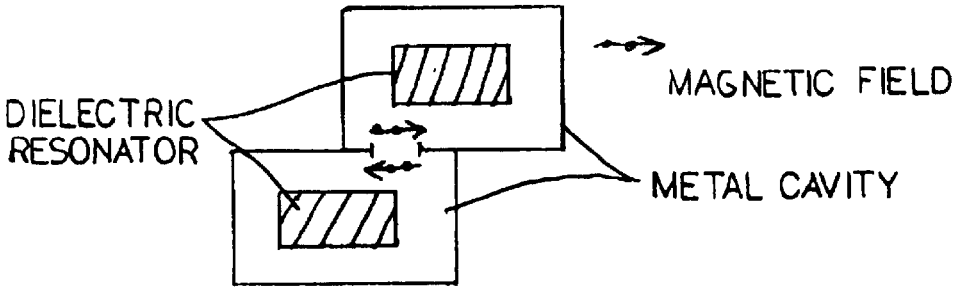
FIG. 10 is a schematic cross-sectional view of a negative radial coupling of two dielectric resonator loaded metal cavities by an aperture.
Figure 11:
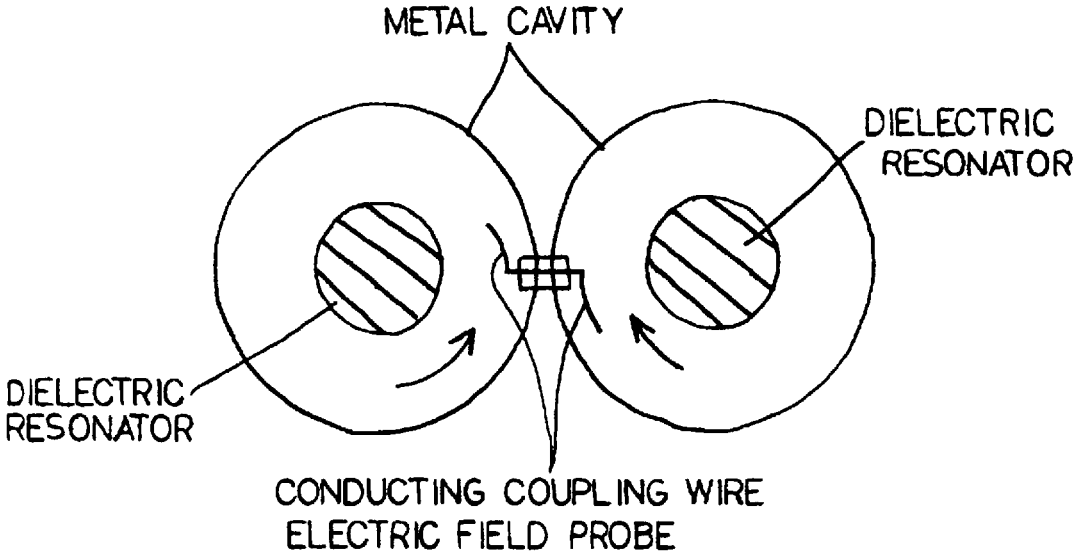
FIG. 11 is a schematic cross-sectional view of a positive side coupling of two dielectric loaded metal cavities by a coupling probe.
Figure 12:
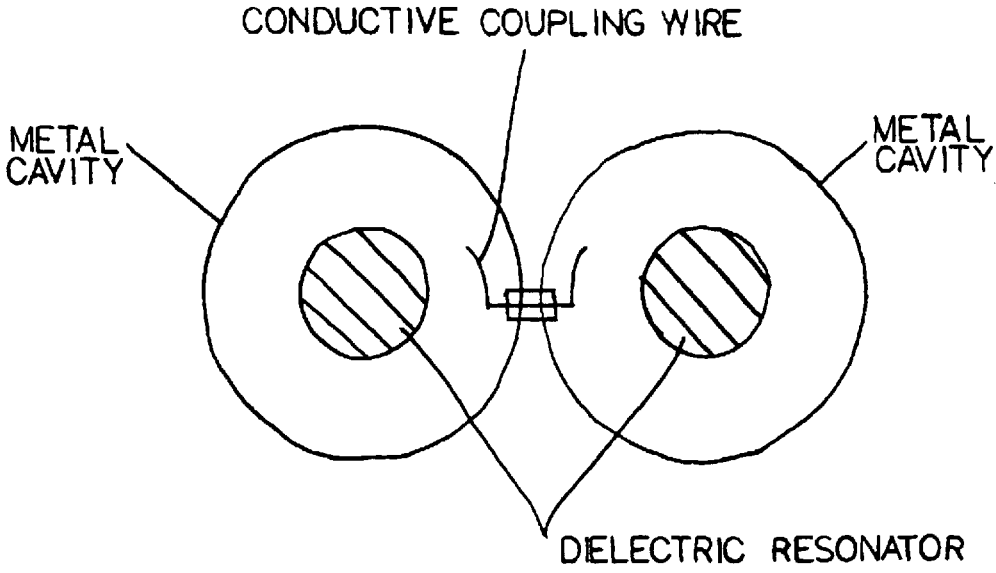
FIG. 12 is a schematic cross-sectional view of a negative side coupling of two dielectric loaded metal cavities by a coupling probe.
Figure 13:
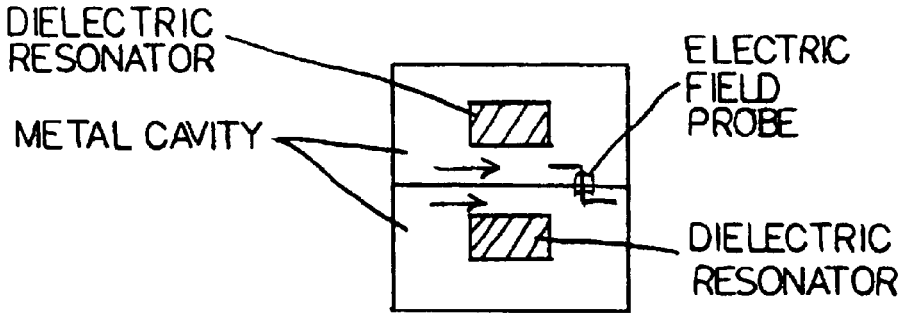
FIG. 13 is a schematic cross-sectional view of a positive radial coupling of two dielectric loaded metal cavities by a coupling probe.
Figure 14:
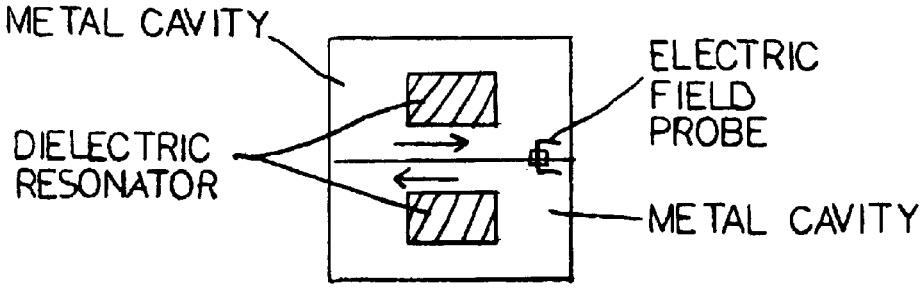
FIG. 14 is a schematic cross-sectional view of a negative radial coupling of two dielectric loaded metal cavities by a coupling probe.
Figure 15:
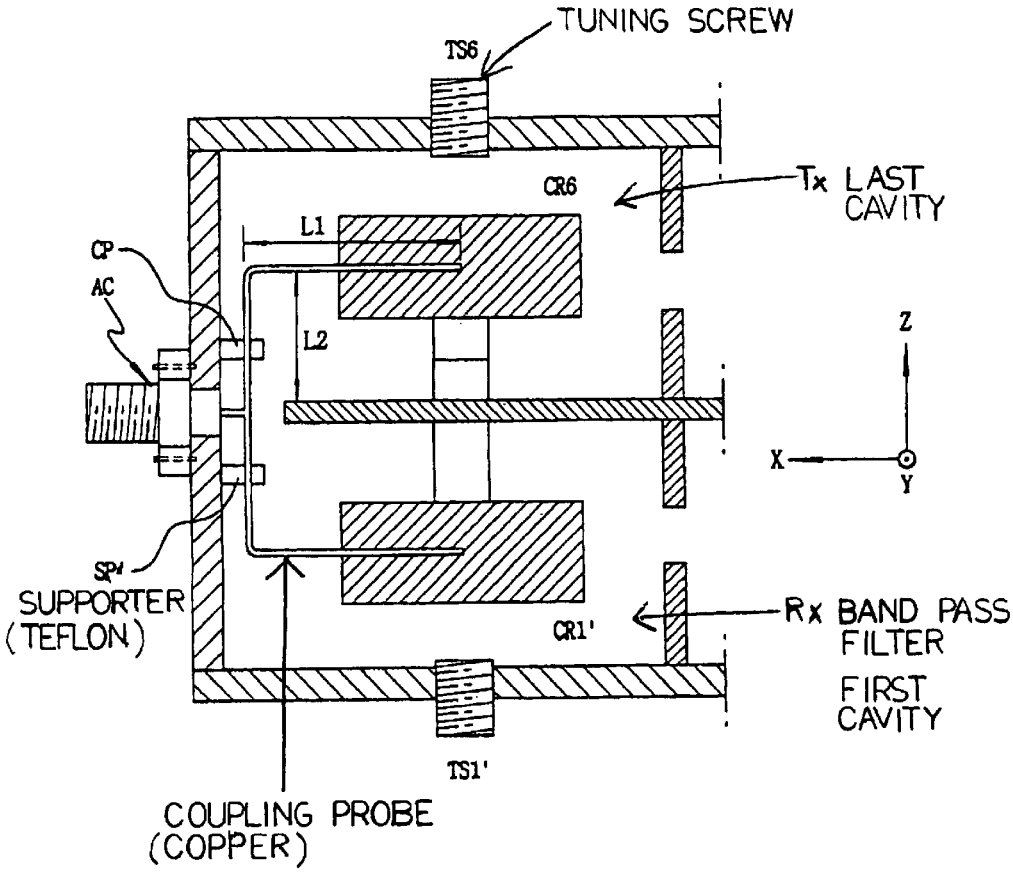
FIG. 15 is a schematic cross-sectional view of an antenna coupling configuration.
Figure 16:
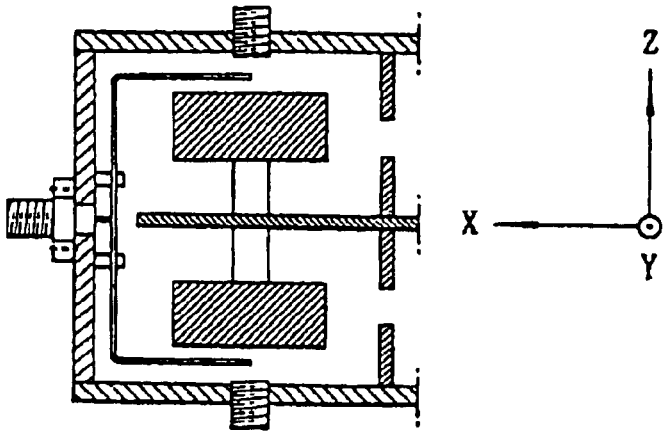
FIG. 16 is a schematic cross-sectional side view of an antenna coupling configuration.
Figure 17:
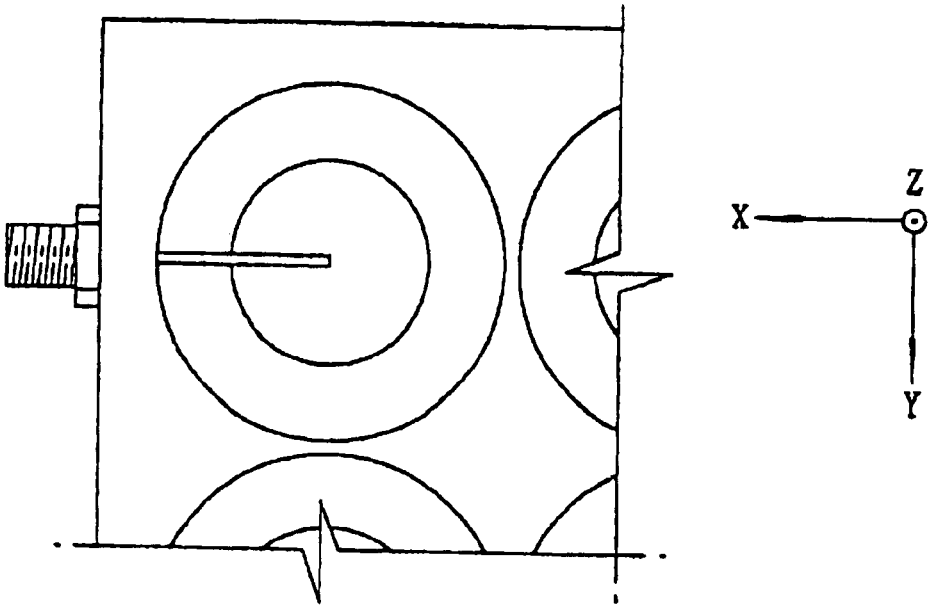
FIG. 17 is a schematic cross-sectional top view of FIG. 16.
Figure 18:
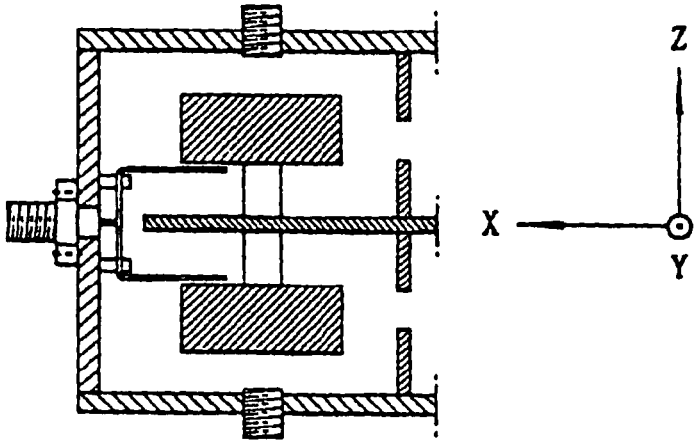
FIG. 18 is a schematic cross-sectional side view of an antenna coupling configuration.
Figure 19:
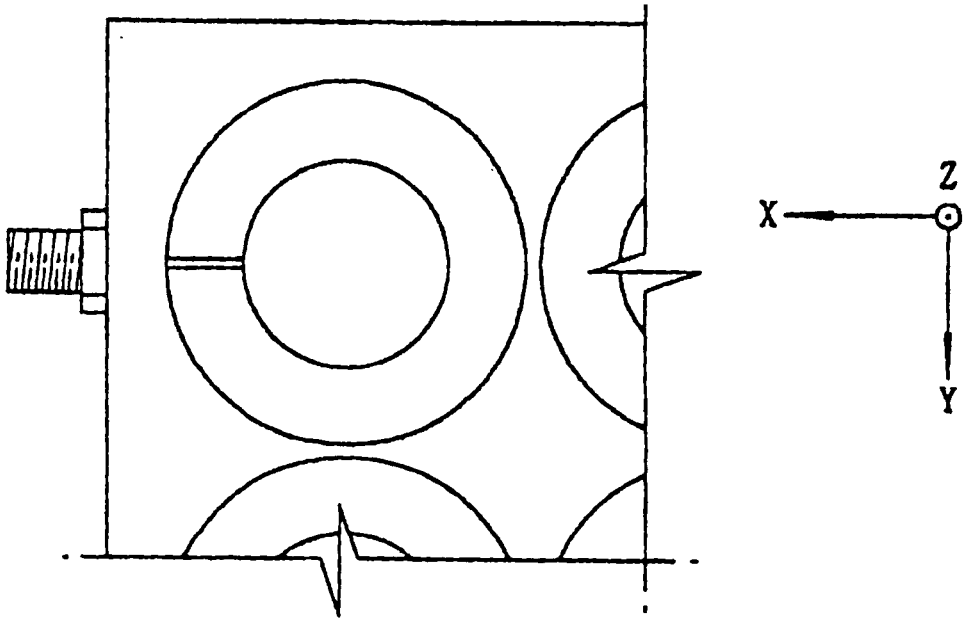
FIG. 19 is a schematic cross-sectional top view of FIG. 18.
Figure 20:
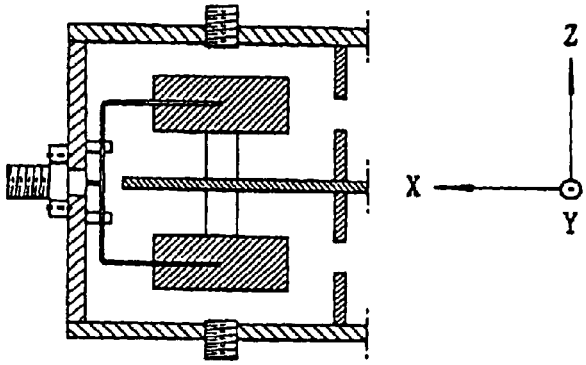
FIG. 20 is a schematic cross-sectional side view of an antenna coupling configuration.
Figure 21:
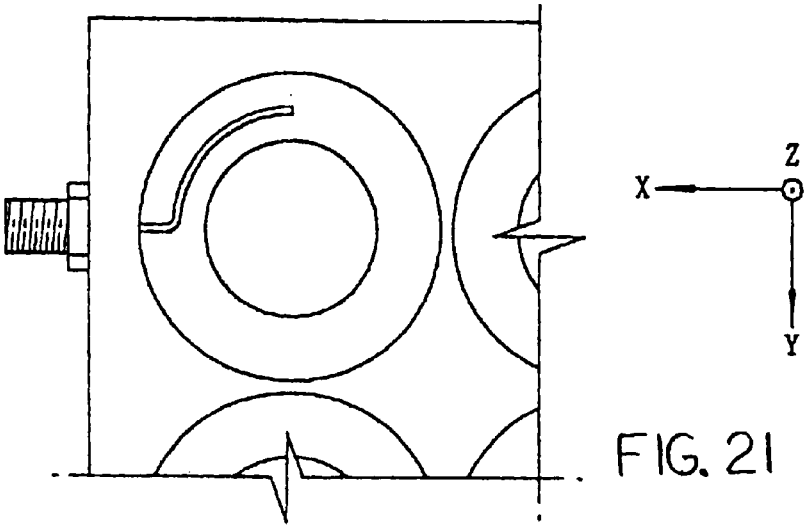
FIG. 21 is a schematic cross-sectional top view of FIG. 20.
Figure 22:
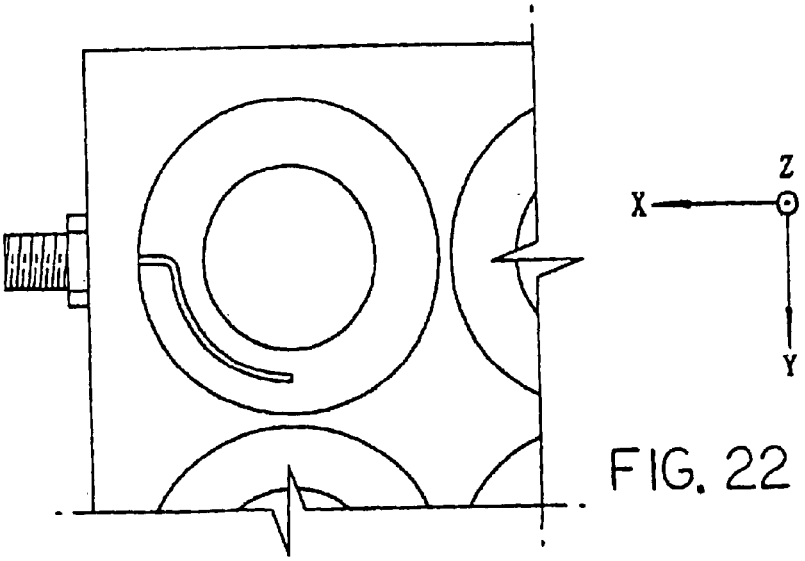
FIG. 22 is a schematic cross-sectional bottom view of FIG. 20.

FIGS. 8–22 show different coupling configurations between cavities and input/output sources FIGS. 8–10 shows three possible ways of coupling two dielectric resonator loaded metal cavities using an aperture. FIG. 8 shows a positive side coupling, FIG. 9 shows a positive radial coupling, and FIG. 10 shows a negative radial coupling. Note that all couplings in FIGS. 8–10 are of the magnetic field coupling type. FIGS. 11–14 shows four possible ways of coupling two dielectric resonator loaded metal cavities by using a coupling probe, which is usually a conducting wire. FIG. 11 shows positive side coupling of two cavities side-by-side. FIG. 12 shows negative side coupling of two cavities side-by-side. FIG. 13 shows positive radial coupling of two cavities stacked together. FIG. 14 shows negative radial coupling of two cavities stacked together. Note that all couplings in FIGS. 11–14 are of the electric field coupling type via the probe, but the resonator in each cavity interacts with the probe using a magnetic field. The probe is usually of a copper material. FIGS. 15–22 show examples of antenna coupling probe configurations, where the cavities are stacked. FIGS. 15–22 show two probes connected to an input/output source. FIGS. 15–22 the input/output source as an antenna connector. FIG. 15 shows the connections of the probe and antenna connector. The probes of FIGS. 16–17 extend over the top of the resonator, whereby the top of the resonator is opposite the resonator support. The probes of FIGS. 18–19 extend under the bottom of the resonator, whereby the bottom of the resonator is where the resonator is supported by the resonator support. The probes of FIGS. 20–22 extend about the sides of the resonator.

Figure 23:
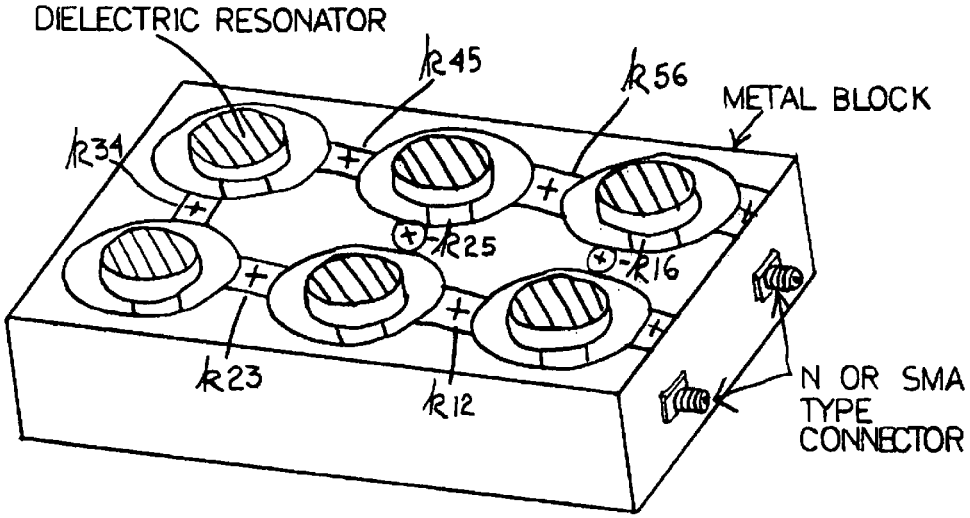
FIG. 23 is a schematic perspective view of a six-pole dielectric resonator loaded metal cavity elliptic function filter.
Figure 25:
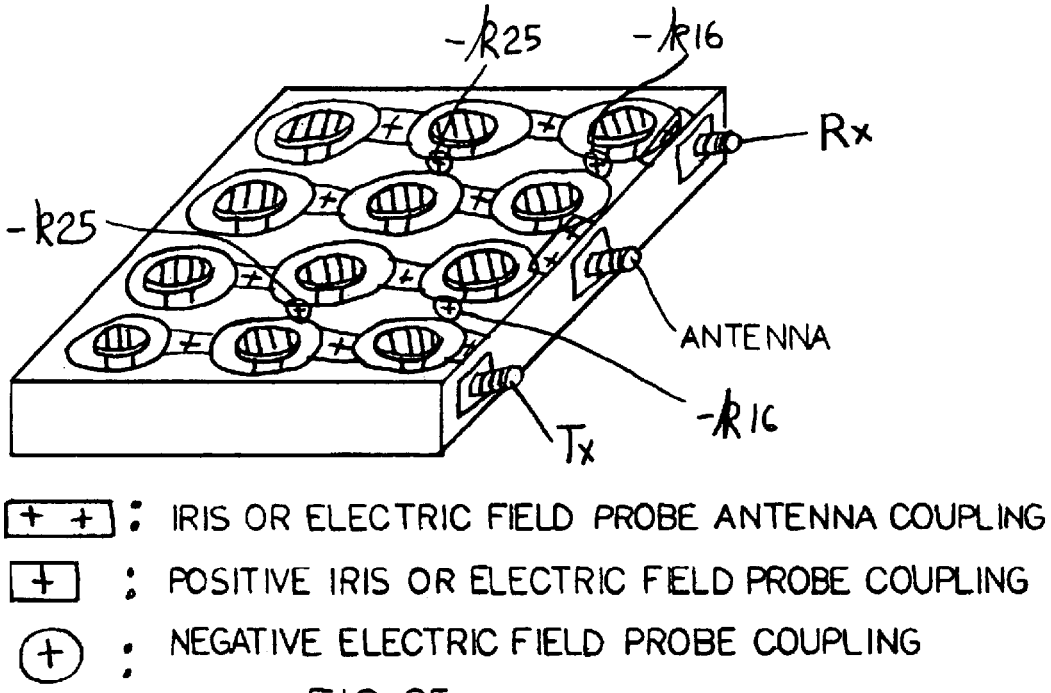
FIG. 25 is a schematic perspective view of a duplexer filter made of two dielectric resonator loaded six-pole metal cavity filters of FIG. 23.
Figure 27:
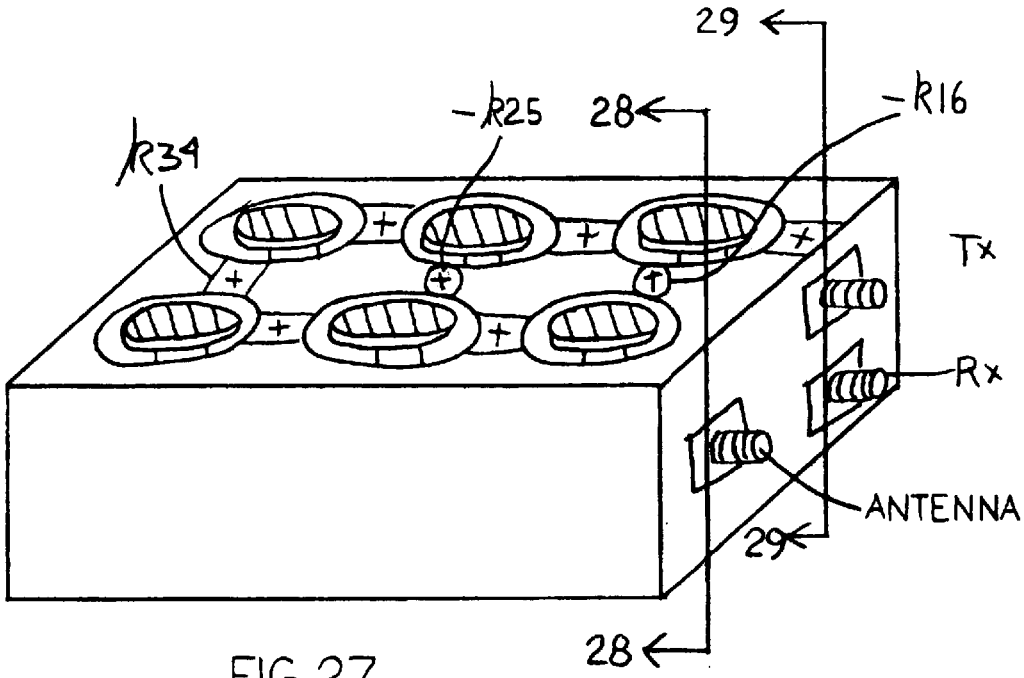
FIG. 27 is a schematic perspective view of a compact duplexer filter according to the present invention.
Figure 28:
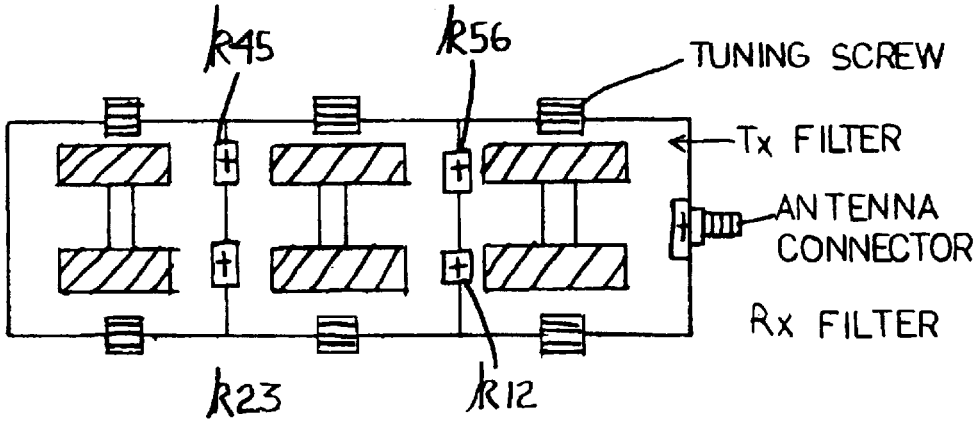
FIG. 28 is a schematic cross-sectional side view of FIG. 27.
Figure 29:
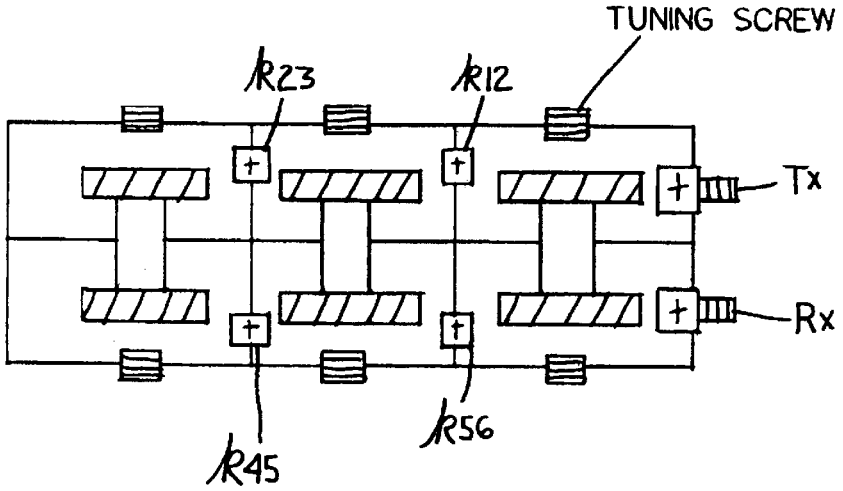
FIG. 29 is a schematic cross-sectional side view of FIG. 27.

FIGS. 27–32 show examples of the new method of stacking dielectric resonator loaded metal cavities to form compact filters and duplexers. FIGS. 27–29 shows an elliptic function duplexer filter having an antenna side and an input/output side. The antenna side is dedicated to an antenna. The input/output side is dedicated to the transmitting (Tx) and receiving (Rx) of a device to which the filter would be connected. The duplexer filter shown in FIGS. 27–29 is the combination of two of the filter type that is shown in FIG. 23. FIG. 27 shows a perspective view of the duplexer filter with a cover removed and depicting how the cavities are coupled. FIG. 28 shows a schematic cross-sectional view through section 28—28 of FIG. 27. FIG. 29 shows a schematic cross-sectional view through section 29—29 of FIG. 27. As shown in FIG. 27, all cavity couplings, k(1,2), k(2,3), k(3,4), k(4,5), k(5,6); negative elliptic cavity couplings, −k(1,6), −k(2,5); and Input/Output couplings for both Tx and Rx band pass filters can be employed by using the coupling methods shown in FIGS. 8–22. The couplings shown in FIGS. 27–29 use the same designation as used in FIGS. 23 and 25. The antenna side of the duplexer shown in FIGS. 27–28 includes a top row of resonator loaded cavities and a bottom row of resonator loaded cavities. The input/output side shown in FIGS. 27 and 29 includes a top row of resonator loaded cavities dedicated to the Tx and a bottom row of resonator loaded cavities dedicated to the Rx. Whereby, the top row of the antenna side is coupled to the top row of the input/output side and the bottom row of the antenna side is coupled to the bottom row of the input/output side. By using antenna coupling configurations shown in FIGS. 15–22, a duplexer filter with a symmetrical top and bottom arrangement using two of the filter shown in FIG. 23 can be constructed instead a symmetrical side by side arrangement of a conventional duplexer shown in FIG. 25.

Figure 30:
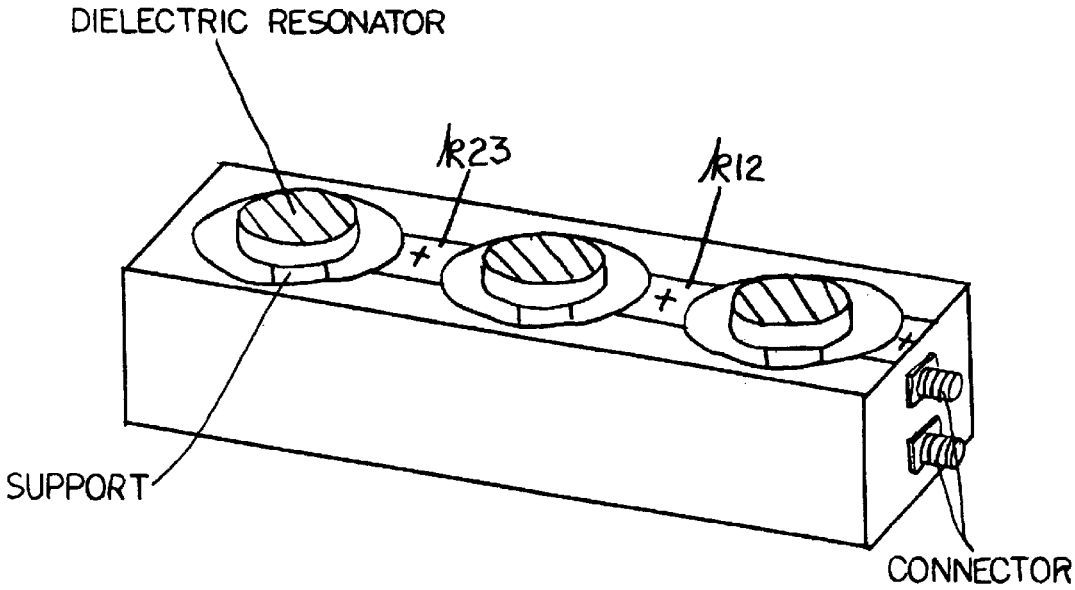
FIG. 30 is a schematic perspective view of a compact filter according to the present invention.
Figure 31:
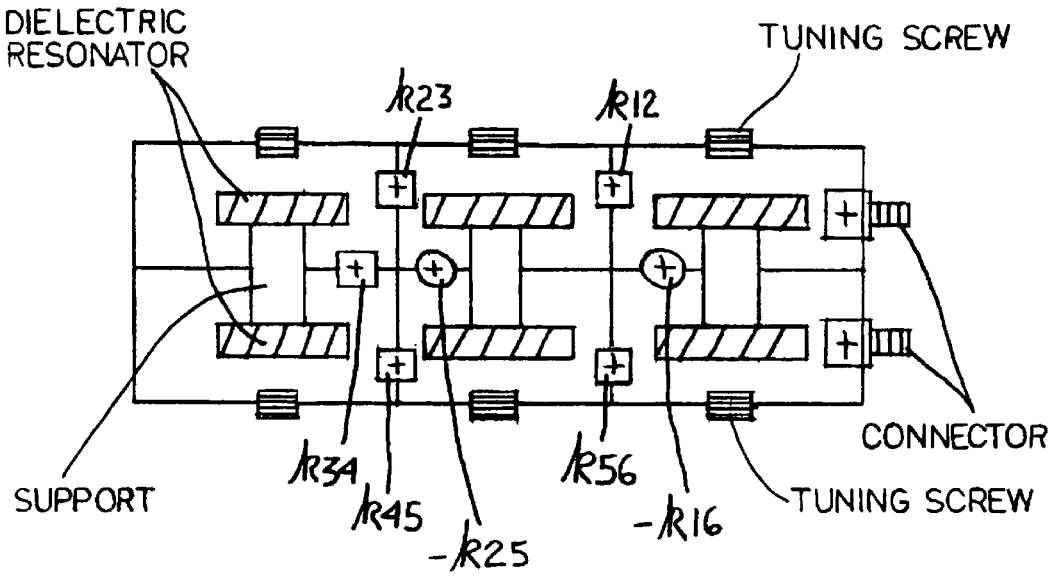
FIG. 31 is a schematic cross-sectional side view of FIG. 30.
Figure 32:
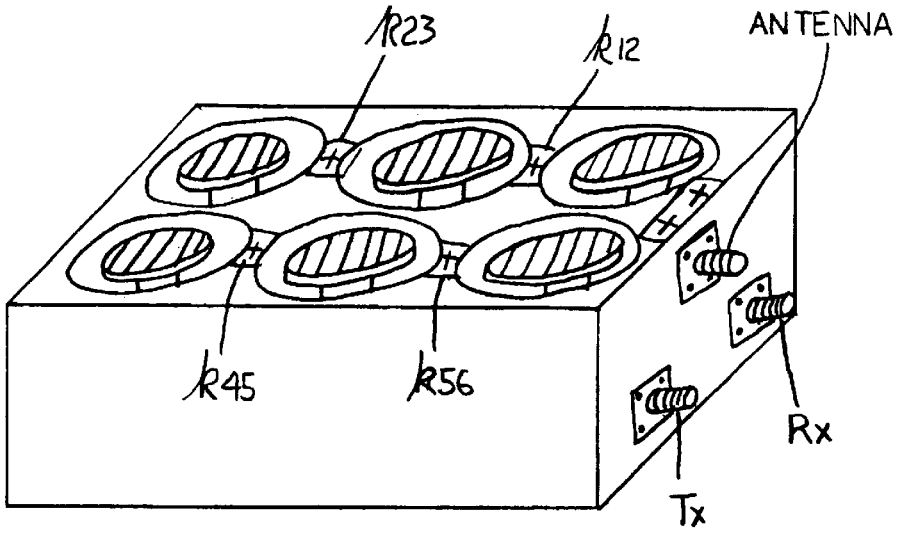
FIG. 32 is a schematic perspective view of another compact duplexer filter according to the present invention.

FIG. 30 is a six-pole dielectric loaded metal cavity elliptic function filter designed according to the stacking method of the present invention. In FIG. 30 a top row of three resonator loaded cavities are stacked on top of a bottom row of three resonator cavities. The side and radial coupling methods of FIGS. 8–22 are employed to couple the cavities of the filter in FIG. 30. As shown in FIG. 31, the couplings of k(1,2), k(2,3), k(4,5), k(5,6), and input/output to cavities 1 and 6 are all positive side couplings and use the same designation as used in FIGS. 23 and 25. The coupling k(3,4) is a positive radial coupling. The elliptic couplings, −k(2,5) and −k(1,6) are negative radial coupling. FIG. 32 is a dielectric resonator loaded metal cavity elliptic function duplexer filter made of two of the stacked filters shown in FIG. 30. The couplings shown in FIG. 32 use the same designation as used in FIGS. 23 and 25.

Figure 24:
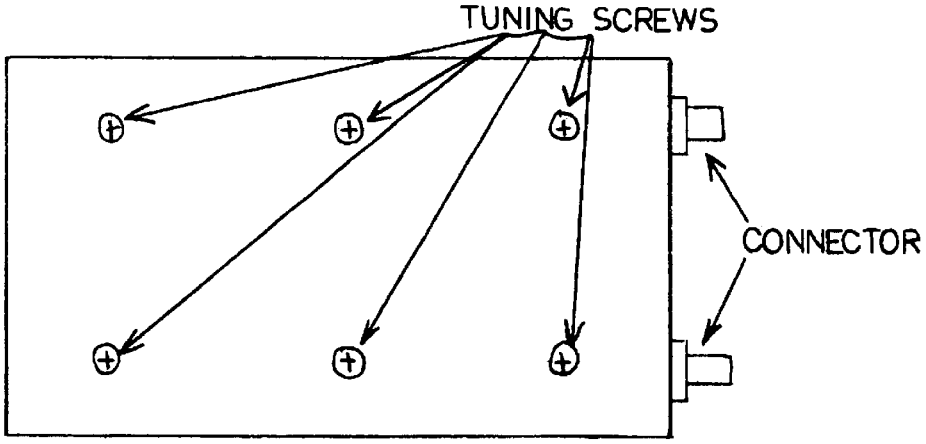
FIG. 24 is a schematic top view of a cover for the filter of FIG. 23.
Figure 26:
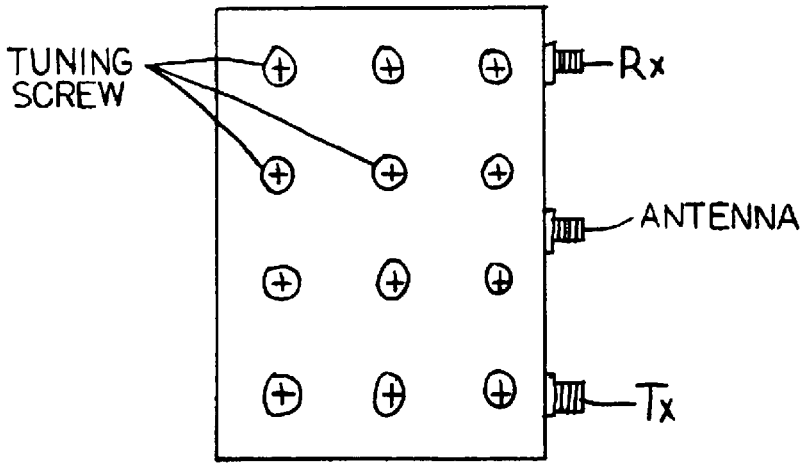
FIG. 26 is a schematic top view of a cover for the filter of FIG. 25.

The top and bottom covers for the filters shown in FIGS. 27–32 are similar to the top covers shown in FIGS. 24 and 26. The top and bottom covers would include tuning screws for each cavity covered. The examples discussed above are not limited to three cavities per row. There could be two cavities per row or an N number of cavities per row. There also could be a mixture of the number cavities per row stacked on each other in a filter. For example there could be three cavities on a bottom row and two cavities on a top row which is stacked on the bottom row. As discussed above, using the stacking method of the present invention allows for the building of more compact dielectric resonator loaded metal cavity filters and duplexers.

The present invention provides a dielectric resonator loaded cavity filter and a method of making such a filter with an improved spurious frequency response over current available filters of this type. Current dielectric resonator loaded cavity filters not only allow the desired frequency to pass, but also undesired higher order harmonics of the desired frequency. The present invention provides a method of making a dielectric resonator filter or duplexer which inhibits the undesired higher order harmonics from passing through the filter. The method of the present invention includes differentiating sizes of the dielectric resonator and metal cavity as compare to other cavities in the filter to prevent the passage of undesired higher order harmonics through the filter. This method can be applied to filters of the prior art in FIGS. 23–26, as well as to the stacking of cavities method of present invention, as described above.

Figure 1:
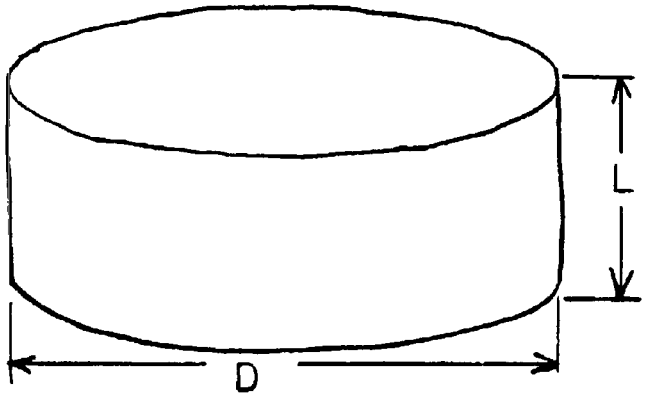
FIG. 1 is schematic perspective view of a dielectric resonator.
Figure 2:
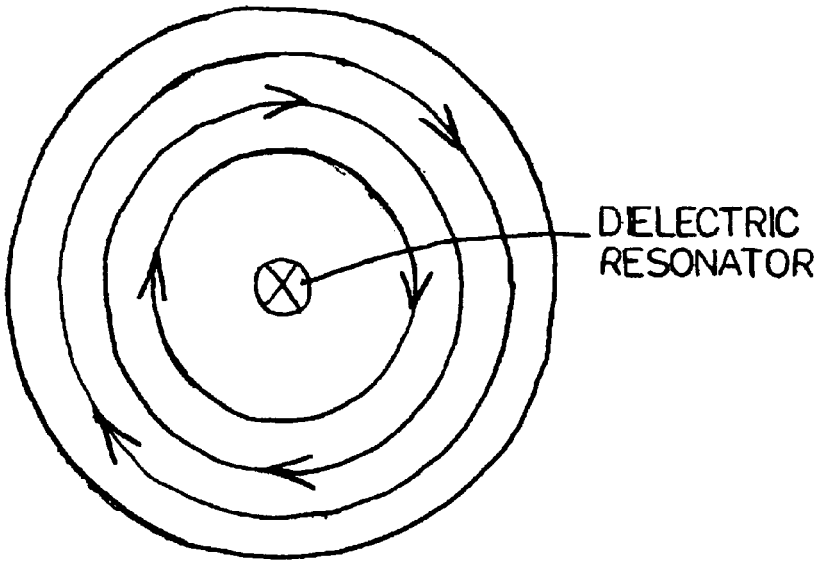
FIG. 2 is a schematic top view of an electric field of a dielectric resonator.
Figure 3:
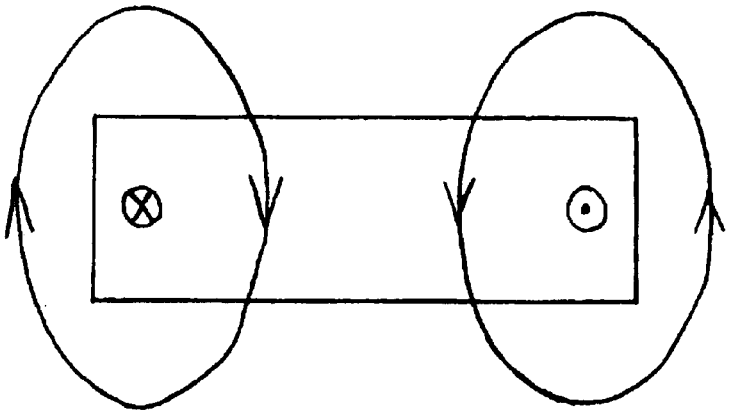
FIG. 3 is a schematic side view of a magnetic field of a dielectric resonator.
Figure 4:
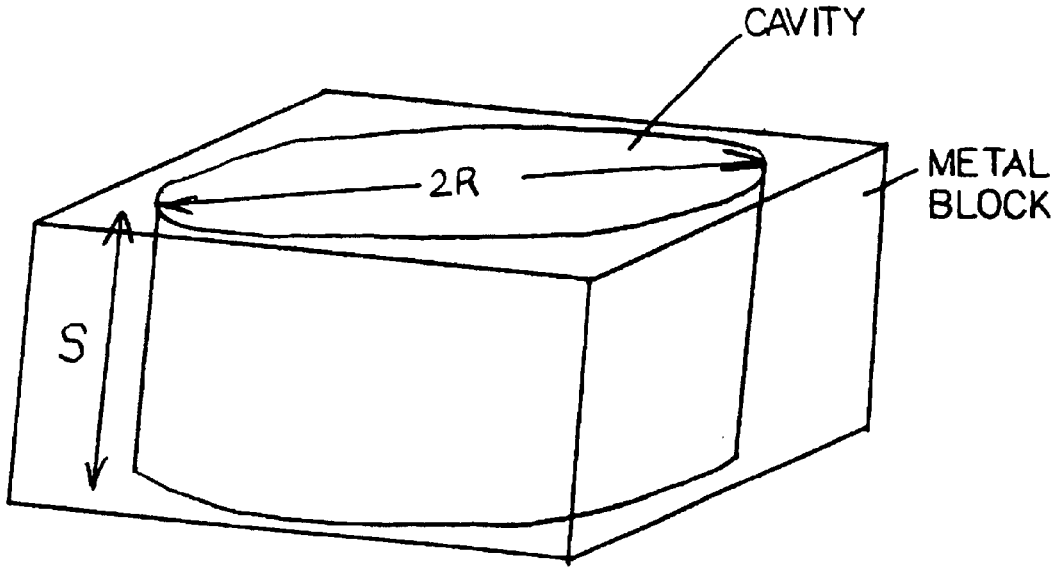
FIG. 4 is a schematic perspective view of a metal block with a cavity.
Figure 5:
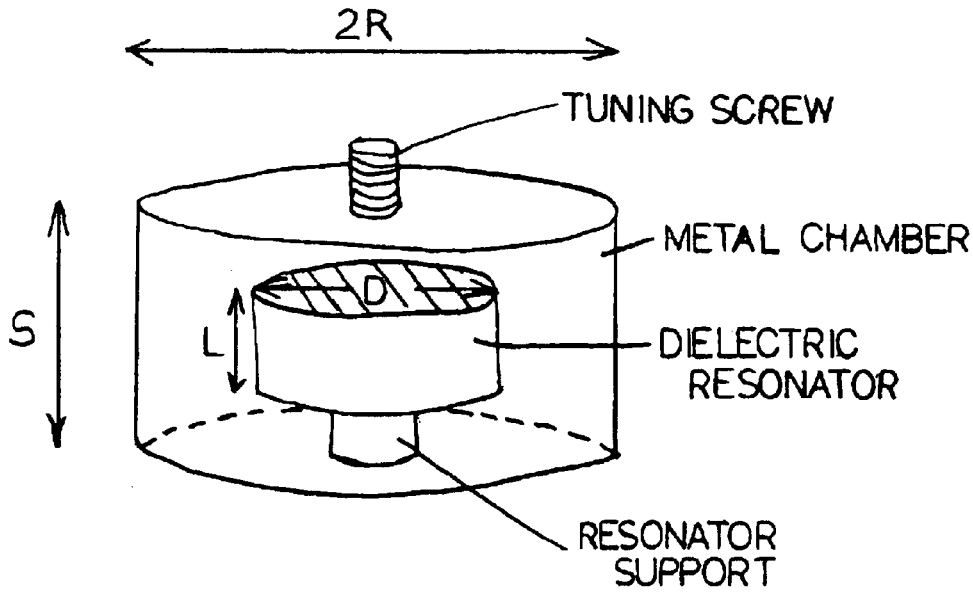
FIG. 5 is a schematic perspective view of a cavity loaded with a resonator.
Figure 6:
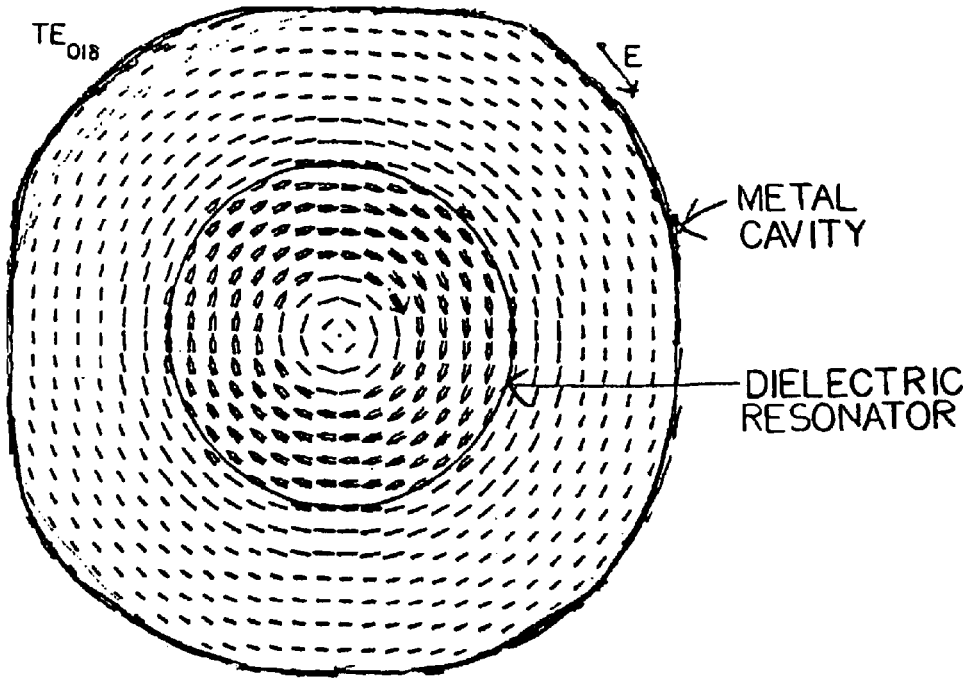
FIG. 6 is a detailed schematic top view of an electric field of a dielectric resonator.
Figure 7:
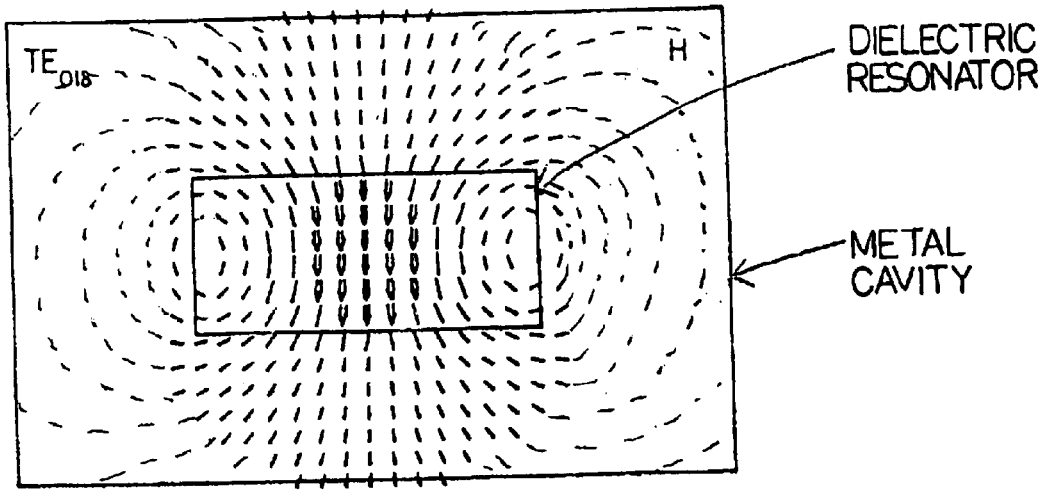
FIG. 7 is a detailed schematic side view of a magnetic field of a dielectric resonator.
Figure 33:
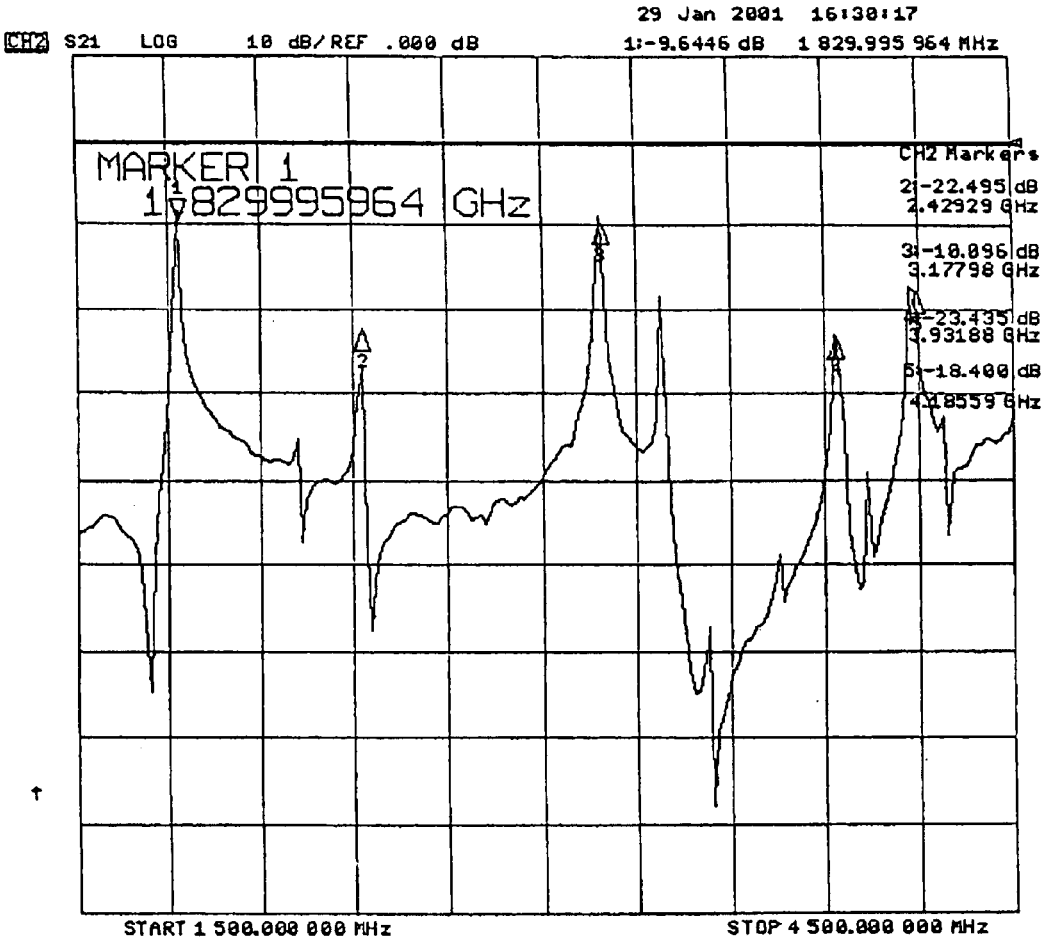
FIG. 33 is a frequency response diagram of a filter having a dielectric resonator with the physical parameters of D=2.8 Cm and L=1.4 Cm and a loaded metal cavity with the physical parameters of 2R=7.5 Cm and S=3.75 Cm.

Examples of the method of making dielectric resonator loaded cavity filter to prevent the passage of undesired higher order harmonics through the filter according to the present invention are as follows. Two different sizes of dielectric resonators where made according to the resonator shown in FIG. 1. Resonator 1 had the dimension parameters of D1=2.8 Cm and L1=1.4 Cm, while resonator 2 had the dimension parameters of D2=3.0 Cm and L2=1.17 Cm. Also, two different sizes of metal cavities were made according to FIG. 4. Cavity 1 had the dimension parameters of 2R1=7.5 Cm and S1=3.75 Cm and while cavity 2 had the dimension parameters 2R2=8.0 Cm and S2=4.0 Cm. The above specifications for each of the resonators and cavities were chosen so that the same first harmonic of a resonant frequency would resonate when any combination of them where assembled. FIG. 33 shows the frequency response of the cavity 1 loaded with the resonator 1. The cursor #1 is located at the first harmonic of about 1.83 GHz, and the rest of cursors #2, #3, #4, and #5, are indicating unwanted higher order modes.

Figure 34:
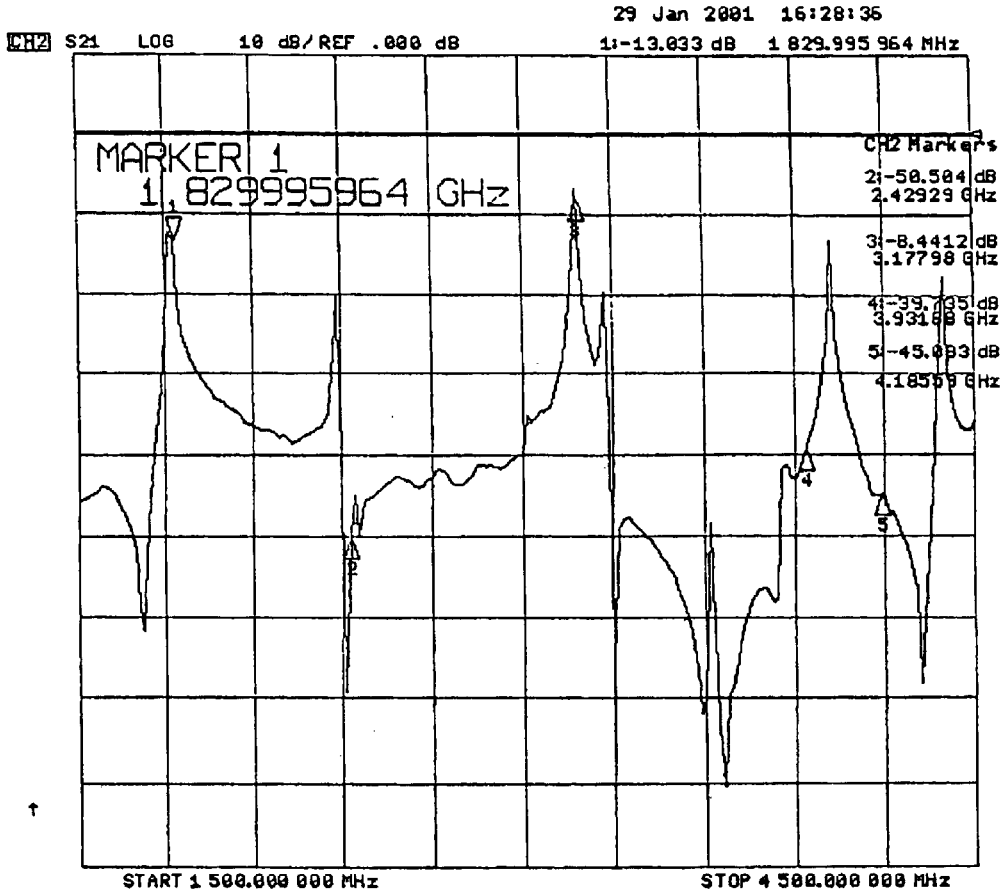
FIG. 34 is a frequency response diagram of a filter having a dielectric resonator with the physical parameters of D=3.0 Cm and L=1.17 Cm and a loaded metal cavity with the physical parameters of 2R=7.5 Cm and S=3.75 Cm.
Figure 35:
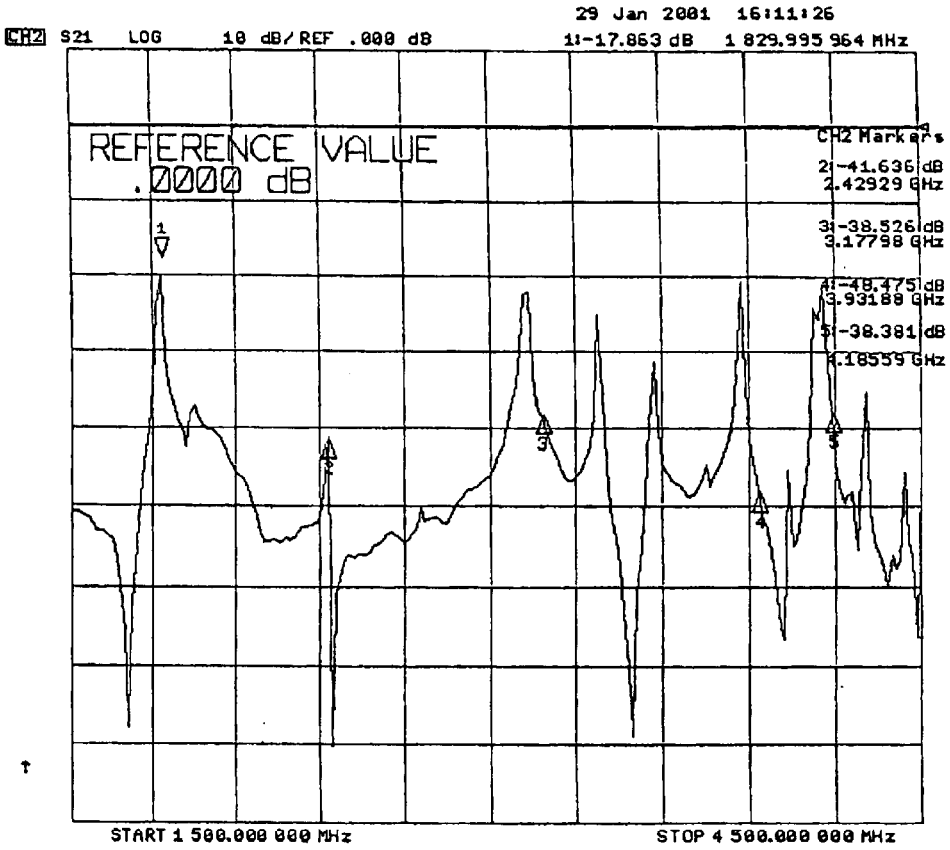
FIG. 35 is a frequency response diagram of a filter having a dielectric resonator with the physical parameters of D=2.8 Cm and L=1.4 Cm and a loaded metal cavity with the physical parameters of 2R=8.0 Cm and S=4.0 Cm.
Figure 36:
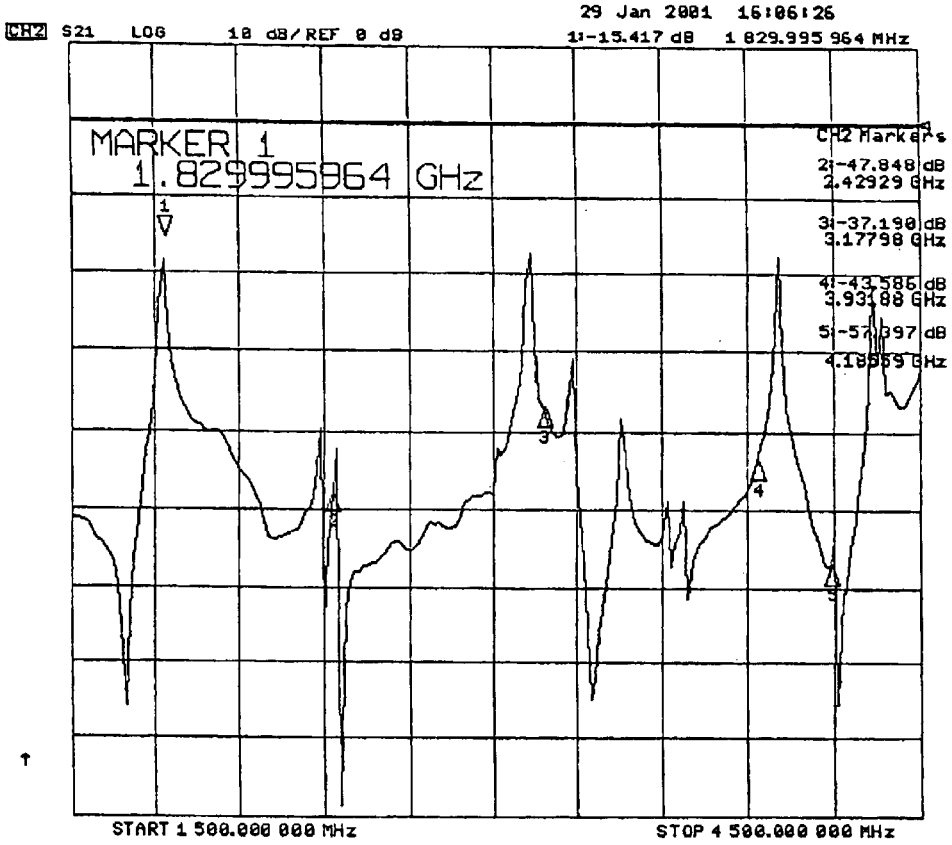
FIG. 36 is a frequency response diagram of a filter having a dielectric resonator with the physical parameters of D=3Cm and L=1.17Cm and a loaded metal cavity with the physical parameters of 2R=8.0Cm and S=4.0Cm.

FIG. 34 shows the frequency response of the cavity 1 loaded with resonator 2. The cursor #1 is located at the same frequency as FIG. 33, but the cursors #2, #4, and #5, are shifted significantly. However the cursor #3 is located at the same frequency as cursor #3 in FIG. 33. Therefore, the frequency response of the resonator loaded cavities shown in FIGS. 33 and 34 have a primary resonant frequency at cursor #1 and unwanted higher mode cursor #3. FIG. 35 shows the frequency response of the cavity 2 loaded with resonator 1. The cursors #1 and #2 are located at the same frequency as FIG. 33 and cursors #3, #4, and #5, are shifted significantly in this case. FIG. 36 shows the frequency response of the cavity 2 loaded with resonator 2. All higher order mode harmonics, cursors #2, #3, #4, and #5, are shifted significantly, as compared to FIG. 33. Only the primary resonant harmonic, cursor #1, is located at the same frequency at about 1.83 GHz as designed like FIGS. 33, 34, and 35. Consequently, the frequency response of a dielectric resonator loaded metal cavity filter having at least one different value for the dimension parameters of the dielectric resonator and/or the metal cavity will exhibit improved spurious frequency characteristics. Therefore, by coupling the resonator/cavity combinations of FIGS. 33 and 36, a filter can be built that only passes the first harmonic of the resonant frequency. This concept can be applied to the filters of FIGS. 23, 25 of the prior art, the stacked filters of FIGS. 27, 30, and 32, and other different sizes and poles versions of the dielectric resonator loaded cavity filters.

It is also possible to design the filters shown in FIGS. 23, 25, 27, 30 and 32, and other sizes and poles of the dielectric resonator loaded cavity filters by replacing at least one of the dielectric resonators with a dielectric resonator made of different dielectric material than that of others in the filter. For an example, one resonator could have a dielectric constant of K=45 and the others in the filter have a dielectric constant of K=37. Note, the dielectric resonator and metal cavity sizes will have to be different in order to pass the same first harmonic frequency for a metal cavity loaded with a dielectric resonator made of different dielectric material as compare to others.

While different embodiments of the invention have been described in detail herein, it will be appreciated by those skilled in the art that various modifications and alternatives to the embodiments could be developed in light of the overall teachings of the disclosure. Accordingly, the particular arrangements are illustrative only and are not limiting as to the scope of the invention that is to be given the full breadth of any and all equivalents thereof.

I claim:

1. A duplexer filter of resonator loaded cavities for transmitting and receiving signals to and from a device comprising:

a first electrical connector for transmitting and receiving signals;

a second electrical connector for passing a signal from the device to said first electrical connector;

a third electrical connector for passing a signal to the device from said first electrical connector;

a first filter of at least three resonator loaded cavities coupled between said first and second electrical connectors to allow exchange of a desired frequency between said first and second electrical connectors, wherein each of said cavities is loaded with a resonator; and a second filter of at least three resonator loaded cavities coupled between said first and third electrical connectors to allow exchange of a desired frequency between said first and third electrical connectors, wherein each of said cavities is loaded with a resonator;

wherein said first filter is stacked in relation to said second filter, as opposed to being positioned side-by-side each other;

wherein side-by-side positioning of said cavities is relative to the sides of the resonators, and wherein stacking of said cavities is relative to tops and bottoms of said cavities;

wherein each of said first and second filter each include at least four resonator loaded cavities coupled side by side in at least a two-by-two matrix.

2. The filter of claim 1; wherein said resonator is a cylinder shape having a round top, a round bottom and a continuous side between said top and bottom.

3. The filter of claim 1, wherein at least one cavity of said first set is negatively coupled to at least one cavity of said second set in order to employ elliptic function filter theory in said filter.

* * * * *